US007390290B2

(12) United States Patent
Gustafsson et al.

(10) Patent No.: US 7,390,290 B2
(45) Date of Patent: Jun. 24, 2008

(54) PACKAGING MACHINE

(75) Inventors: Per Gustafsson, Bjarred (SE); Jan Lovenbrandt, Lomma (SE); Bengt Malmstrom, Vellinge (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 112 days.

(21) Appl. No.: 10/501,986

(22) PCT Filed: Jan. 14, 2003

(86) PCT No.: PCT/SE03/00039

§ 371 (c)(1),
(2), (4) Date: Jul. 21, 2004

(87) PCT Pub. No.: WO03/062065

PCT Pub. Date: Jul. 31, 2003

(65) Prior Publication Data

US 2005/0070411 A1 Mar. 31, 2005

(30) Foreign Application Priority Data

Jan. 21, 2002 (SE) ..... 0200194

(51) Int. Cl.
*B31B 3/28* (2006.01)

(52) U.S. Cl. ..... 493/67; 493/64; 493/84; 493/105; 493/164

(58) Field of Classification Search ..... 493/64, 493/65, 67–72, 105, 84, 162–164, 165
See application file for complete search history.

(56) References Cited

U.S. PATENT DOCUMENTS 3,957,415 A * 5/1976 Edwards ..... 425/534
4,564,139 A * 1/1986 Reil ..... 229/5.5
4,604,850 A * 8/1986 Reil ..... 53/423
4,834,823 A * 5/1989 Reil ..... 156/217
5,135,462 A 8/1992 Stahlecker et al.
6,663,926 B1 12/2003 Okushita et al.

FOREIGN PATENT DOCUMENTS

EP 0165204 A 12/1985
EP 0640525 A 3/1995

(Continued)

*Primary Examiner*—Christopher Harmon
(74) *Attorney, Agent, or Firm*—Buchanan Ingersoll & Rooney PC

(57) ABSTRACT

The present invention relates to an apparatus for manufacturing packages, comprising a fist plurality of arms (2) which are at substantially equal mutual spacing, on symmetric distribution about a circle, radially extend about a geometric axis (X) and located in a common plane at right angles to the axis, as well as a second plurality of treatment stations (4) which are disposed a radial distance from the axis (X), as well as rotary means which are disposed to rotate the arms intermittently about the axis (X) between the treatment stations (4), the arms (2) and the treatment stations (4) being disposed in relation to one another such that the position of the arms (2) and the position of the treatment stations (4) coincide after the intermittent rotations. In a single indexing state, the apparatus (1) is configured to be disposed to rotate the arms to one distribution at a time, and in a double indexing state, to be disposed to rotate the arms (2) two distributions at a time.

12 Claims, 1 Drawing Sheet

FOREIGN PATENT DOCUMENTS

| | | | | |
|---|---|---|---|---|
| EP | 0862980 | A1 | | 9/1998 |
| EP | 0960014 | B1 | | 7/2001 |
| GB | 2205805 | A | | 12/1988 |
| JP | 4-229240 | A | | 8/1992 |
| JP | 11-314286 | A | | 11/1999 |
| WO | WO 0044621 | A | | 8/2000 |
| WO | WO 00/75017 | | * | 12/2000 |
| WO | WO 98/32666 | A1 | | 5/2003 |

* cited by examiner

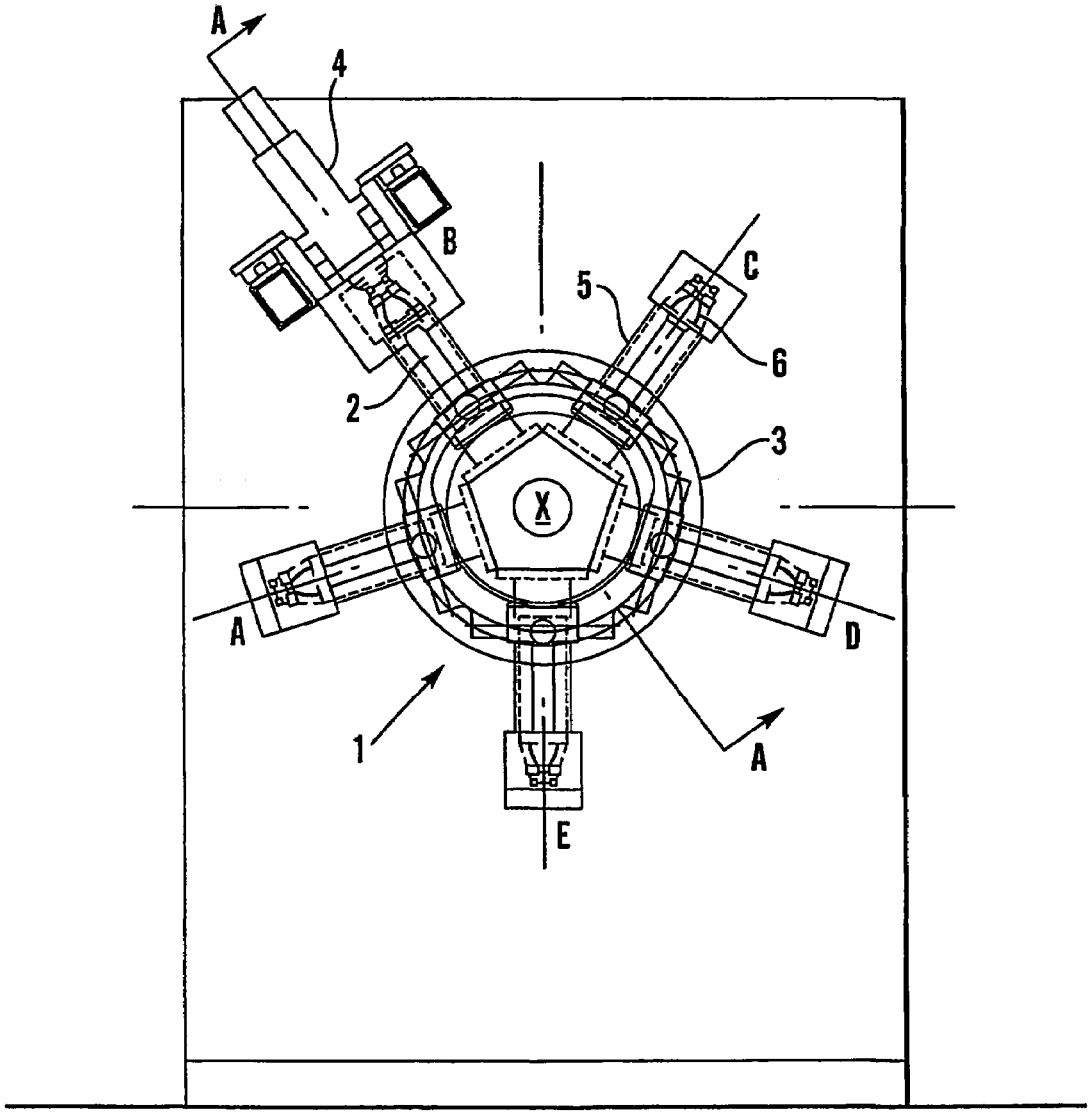
A
4
B
C
5
6
2
3
X
A
D
1
A
E

PACKAGING MACHINE

TECHNICAL FIELD

The present invention relates to an apparatus and a method in the manufacture and handling of packages and parts thereof.

BACKGROUND ART

There are numerous different types of packages for various liquid contents available on the market. These packages may, for example, be manufactured from aluminium, plastic or laminated paperboard. For different types of liquids, different materials and designs of the package may be appropriate.

The material in the package is also selected on the basis of the physical design of the package. One type of package which is particularly suitable for still drinks consists of a sleeve, a top and a bottom, where the parts included are not necessarily of the same material. For example, the sleeve and the bottom may be of laminated paperboard and be formed in one piece, and the top may consist of injection-moulded plastic. Such a package is described in EP-B1-0 960 014 and WO 98/32666. A similar design where the sleeve is of laminated paperboard and the bottom and top are of plastic and the top is injection-moulded on the casing/sleeve is described in EP-A1-0 862 980.

Both of these types of package may be employed for largely the same type of contents, but are manufactured in different ways and in different machines. These machines are often constructed at a machine manufacturer and are subsequently sold to a packaging manufacturer. Because of the large range of packages available, the variation in machines is consequentially large. In order that a machine manufacturer be able to meet the demand for different types of packing and filling machines, it is necessary that a large number of machine parts to different types of machines be kept in store. Also in product development, it is necessary that every improvement be introduced into a multiplicity of different machine types. For a manufacturer of the machines, it would, therefore, be advantageous to be able, in one way or another, to reduce the number of different machine parts which must be kept in store for manufacture and sale without reducing the range of products available on offer of machines for manufacturing different types of packages.

In the case when a packaging manufacturer wishes to replace package type, the manufacturer must, at the present time, obtain a totally new plant which gives rise to large capital investment costs. It would, therefore, be desirable to realise a plant which may be retooled or retro constructed for different types of packages without the entire machine needing to be replaced.

SUMMARY OF THE INVENTION

The object of the present invention is therefore to realise an apparatus for manufacturing and handling packages, the apparatus permitting the construction, on a common basis, principally of two different types of packing and filling machines.

Hence, the concept of the present invention is, by altering the configuration in one type of packaging machine from the simplest to a slightly more complicated by employing double indexing, to gain the advantage that it is possible to employ a common basis for two different types of packing and filling machines. The term a common basis is taken to signify a common frame, a common shaft suspension, a common housing, a common base plate etc. The infeed of common packaging material and the discharge of packages also take place at the same position in both variations of the machine. To be able to build two machines on the same basis also affords the advantage of more economical store keeping of spare parts, simpler service and better yield of product development, since this, as regards the common parts, realises an improvement for both of the machines. Since it is the acceleration and retardation at the different stations which takes time and not the transport distance, the double indexing does not result in any appreciable increase in the production time for a package. It may even be an advantage for a manufacturer of packages to be able to replace only a part of the packing and filling machine when it is desired to alter the type of package being manufactured. The capital investment costs are approximately halved compared with the case when a totally new machine must be procured.

In the single indexing state, the apparatus may be disposed to rotate the arms in a first direction of rotation, and in the double indexing state be disposed to rotate the arms in a second direction of rotation opposite to the first direction of rotation. This affords the advantage that the apparatus can, on configuration, readily be adapted to different manufacturing processes.

Further, at least one of the treatment stations may include means for applying a packaging sleeve on an arm which is located at this station, which affords the advantage of efficient and simple manufacture.

At least one of the treatment stations may further include means for applying a package top on an arm which is located at this station. This strengthens the above-outlined advantage in the manufacture of a package which has a prefabricated top.

Further, at least one of the treatment stations may include means for closing a joint between the package top and the package sleeve, which also affords simplified and efficient manufacture.

At least one of the treatment stations may also include means for heating a package sleeve and top disposed on an arm, which affords the advantage of simplifying the above-mentioned sealing operation.

According to a second embodiment of the apparatus, this may include means for injection-moulding of a package top on a package sleeve. This affords the advantage of simplifying and making more efficient the manufacture of a package which displays a sleeve with a top injection-moulded thereon.

The apparatus according to the present invention preferably has five arms. This affords the advantage of a simple configuration for realising variations of a machine for the manufacture of the two different packages.

According to one embodiment, the apparatus has, in the single indexing state, a first treatment station in a first sleeve application position a radial distance from the axis for applying a sleeve on an arm, a second treatment station for injection-moulding of a top on the sleeve and a third treatment station in a first discharge position a radial distance from the axis for discharging the sleeve with the top from the arm, and, in the double indexing state, a first treatment station for applying a top on an arm, a second treatment station in a second sleeve application position a radial distance from the axis for applying a sleeve on the arm, a third treatment station for closing a joint between the top and the sleeve, and a fourth treatment station in a second discharge position a radial distance from the axis for discharging the sleeve with the top from the arm.

According to one preferred embodiment of the present invention, the first and second sleeve application positions lie in the same place and the first and second discharge positions in the same place. This gives the advantage mentioned by way of introduction that one basic version may be employed for building different variations which are used for the manufacture of different packages.

BRIEF DESCRIPTION OF THE ACCOMPANYING DRAWING

The present invention will now be described in greater detail hereinbelow, with reference to the accompanying Drawing which shows, for purposes of exemplification, one presently preferred embodiment of an apparatus according to the invention.

The sole FIGURE is a side elevation of an apparatus according to the invention.

DESCRIPTION OF PREFERRED EMBODIMENT

The apparatus 1 in FIG. 1 has five arms 2 which are secured at uniform spacing on a wheel 3 which rotates about a geometric axis X. At each arm, there may be a treatment station 4, but only one such station is shown in the FIGURE. Applied over each arm in the FIGURE, there is a package sleeve 5. In the FIGURE, a package top 6 is also shown.

The wheel 3 may intermittently rotate either clockwise or counterclockwise. The direction of rotation is selected on the basis of that type of package which is to be manufactured. Further, the apparatus 1 is set in a single or double indexing state. In the single indexing state, the arms 2 move during the rotation of the wheel 3 intermittently clockwise from one treatment station 4 to the next in sequence around the axis A, without passing any interjacent station. Thus, the arms move one distribution step at a time. In the double indexing state, the arms 2 move during rotation of the wheel 3 counterclockwise from one treatment station to the second next in sequence around the axis A. Thus, in each step one interjacent treatment station is leapfrogged in that the arms move two spacing distribution at the time.

In order to describe how the machine is configurated for two different types of packages, reference numerals A, B, C, D, E will, in accordance with the FIGURE, be employed for describing the positions of the treatment stations.

When the machine is adapted for the manufacture of a package consisting of a package sleeve and a prefabricated plastic top, the station C is the first station in the manufacturing process. There, a plastic top is applied on the arm. The arm is then rotated counterclockwise to station A where a package sleeve is applied. The arm is then rotated counterclockwise two spacing distributions to the next station in the sequence which is station D, where possible preheating of the sleeve and the top takes place. Thereafter, the arm is rotated through two spacing distributions counterclockwise to the station B where a joint between the top and the sleeve is sealed. Finally, the arm is rotated two spacing distributions counterclockwise to station E where the package is discharged for, for example, filling and sealing.

When the machine is instead adapted for the manufacture of a package consisting of a sleeve on which a top is injection-moulded, station A is the first station. There, just as before, a package sleeve is applied on the arm. Thereafter, the arm is rotated one spacing distribution clockwise to station B where a top is injection-moulded on the sleeve. During the subsequent rotation to station C and subsequently to station D, the top cools in order, at station D possibly to be provided with an opening arrangement on the now cooled top. Finally, the package is, as previously, discharged from the arm at station E for example for filling and sealing. The application of the sleeve and the discharge of the package thus take place at the same place for both of the variations.

What is claimed is:

1. An apparatus for the manufacture of different package types including a first package type and a second package type, comprising:

a plurality of arms which are at substantially equal mutual spacing distributions of a circle and extending radially outwardly about a geometric axis and rotary in a common plane at right angles to the axis, each of the radially outwardly extending arms being adapted to receive a package sleeve, a plurality of treatment stations for manufacture of the different package types including the first package type in which a package sleeve and a prefabricated plastic top are joined to one another and the second package type in which a top is injection-molded on the package sleeve, the plurality of treatment stations including means for applying the package sleeve on one of the radially outwardly extending arms, and rotary means disposed to rotate the arms stepwise about the axis, the apparatus being configurable in both a first indexing state to manufacture the first package type and a second indexing state to manufacture the second package type, the apparatus, in the first indexing state, including a first arrangement of at least some of the plurality of treatment stations disposed a radial distance from the axis including the means for applying the package sleeve, and said rotary means rotating said arms between said first arrangement of treatment stations no more than one spacing distribution at a time in the first indexing state so that the arms stop successively at each successive treatment station of the first arrangement upon each stepwise rotation, and the apparatus, in the second indexing state, including a second arrangement of at least some of the plurality of treatment stations disposed a radial distance from the axis including the means for applying the package sleeve, and said rotary means rotating said arms between said second arrangement of treatment stations at least two spacing distributions at a time in the second indexing state so that the arms stop successively at every other one of the treatment stations of the second arrangement upon each stepwise rotation.

2. The apparatus as claimed in claim 1, which, in the first indexing state, the rotary means rotates the arms in a first direction of rotation and in the second indexing state, the rotary means rotates the arms in a second direction of rotation opposite to the first direction of rotation.

3. The apparatus as claimed in claim 1, wherein at least one of the treatment stations includes means for applying a package top on the arm which is located at this station.

4. The apparatus as claimed in claim 3, wherein at least one of the treatment stations includes means for closing a joint between the package top and the package sleeve.

5. The apparatus as claimed in claim 4, wherein at least one of the treatment stations includes means for heating a package sleeve and top disposed on the arm.

6. The apparatus as claimed in claim 1, wherein at least one of the treatment stations includes means for injection-moulding of a package top on a package sleeve.

7. The apparatus as claimed in claim 1, said apparatus comprising five arms.

8. The apparatus as claimed in claim 1, which, in the first indexing state, has the means for applying as a first treatment station in a first sleeve application position a radial distance from the axis for applying the package sleeve on one of the arms, a second treatment station for injection-moulding of a top on the sleeve and a third treatment station in a first discharge position a radial distance from the axis for discharging the sleeve with the top from the arm.

9. The apparatus as claimed in claim 8, which, in the second indexing state, has a first treatment station for applying a top on one of the arms, the means for applying as a second treatment station in a second sleeve application position a radial distance from the axis for applying the package sleeve on the arm, a third treatment station for closing a joint between the top and the sleeve, and a fourth treatment station in a second discharge position a radial distance from the axis for discharging the sleeve with the top from the arm.

10. The apparatus as claimed in claim 9, said first and second sleeve application positions lying in the same place and said first and second discharge positions lying in the same place.

11. A method in the manufacture of an apparatus for manufacturing a first package type and a second package type, comprising:

releasably securing to the apparatus and rotatably in a plane at right angles to an axis of rotation, a plurality of arms radially outwardly extending at mutually substantially equal spacing distributions, configuring the apparatus to manufacture the first package type by disposing a first arrangement of treatment stations at radial distances from the axis so that the total number of treatment stations in the first arrangement is equal to the total number of arms, and configuring the apparatus to manufacture the second package type which is different from the first package type by disposing a second arrangement of treatment stations at radial distances from the axis so that the total number of treatment stations in the second arrangement is equal to the total number of arms, selecting a first indexing state to rotate the arms no more than one spacing distribution at a time so that the arms stop successively at each successive treatment station at positions coinciding with the first arrangement of treatment stations when the apparatus is configured to manufacture the first package type, selecting a second indexing state to rotate the arms two spacing distributions at a time so that the arms stop successively at every other one of the treatment stations at positions coinciding with the second arrangement of treatment stations when the apparatus is configured to manufacture the second package type; and wherein the configuring of the apparatus to manufacture the first package type comprises disposing the first arrangement of treatment stations to manufacture the first package type in which a package sleeve and a prefabricated plastic top are joined to one another, and wherein the configuring of the apparatus to manufacture the second package type comprises disposing the second arrangement of treatment stations to manufacture the second package type in which a top is injection-molded on a package sleeve.

12. The method according to claim 11, further comprising:

rotating the arms in a first direction of rotation in the first indexing state; and rotating the arms in a second direction of rotation opposite to the first direction of rotation in the second indexing state.

* * * * *